US005549292A

United States Patent [19]

Plain

[11] Patent Number: 5,549,292

[45] Date of Patent: Aug. 27, 1996

[54] SHEET STACKING AND REVERSING SEPARATOR

[75] Inventor: Margaret C. Plain, Rochester, N.Y.

[73] Assignee: Xerox Corporation, Stamford, Conn.

[21] Appl. No.: 332,289

[22] Filed: Oct. 31, 1994

[51] Int. Cl.[6] ..... B65H 39/105

[52] U.S. Cl. ..... 271/291; 355/320

[58] Field of Search ..... 271/291, 225, 271/186, 184, 185, 65; 355/318–321

[56] References Cited

U.S. PATENT DOCUMENTS

| | | | |
|---|---|---|---|
| 2,904,334 | 9/1959 | Cundall et al. | 271/65 |
| 4,228,993 | 10/1980 | Cathers | 271/185 |
| 4,916,493 | 4/1990 | DeVito | 355/321 |
| 4,988,087 | 1/1991 | Sardano et al. | 271/314 |
| 5,014,976 | 5/1991 | Muck et al. | 271/220 |
| 5,147,092 | 9/1992 | Driscoll et al. | 271/184 |
| 5,339,139 | 8/1994 | Fullerton et al. | 355/215 |

FOREIGN PATENT DOCUMENTS

| | | | |
|---|---|---|---|
| 155156 | 7/1986 | Japan | 271/185 |
| 218358 | 9/1987 | Japan | 271/291 |

*Primary Examiner*—William E. Terrell
*Assistant Examiner*—T. Kelly

[57] ABSTRACT

In a sheet output system with a stacking tray for a reproduction apparatus, in which sheets sequentially moving in an output path are fed out from a sheet ejection nip for stacking in the stacking tray, a sheet separating assistance unit is mounted adjacent the ejection nip with three evenly circumferentially spaced radially extending sheet separating arms, with one separating arm automatically normally extending into the output path for engagement and partial rotation and translation solely by a moving sheet lead edge in the output path, while maintaining at least one separating arm in contact with the moving sheet as the moving sheet is fed out from the sheet ejection nip to provide sheet separating assistance, even if the nip reverses for duplexing. The automatic realignment of the device to a lead edge catching position after each sheet is provided by gravity with an eccentric over-center mounting system with a large triangular shaped mounting aperture.

9 Claims, 2 Drawing Sheets

SHEET STACKING AND REVERSING SEPARATOR

Figure 1:
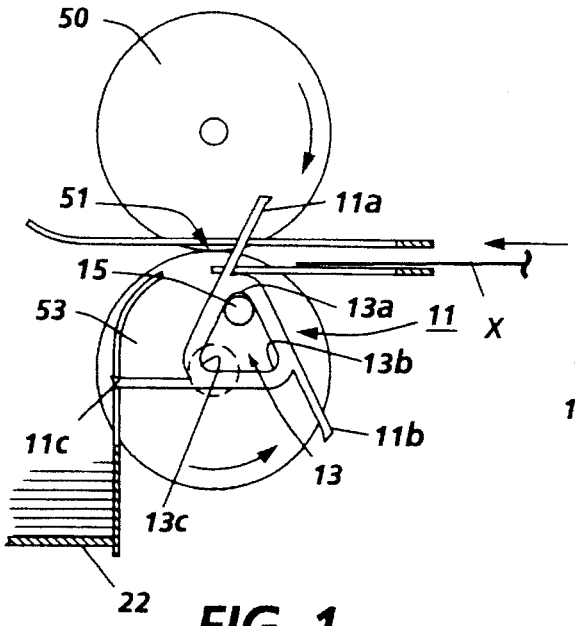

Disclosed is a simple, compact, low cost, sheet separating and/or stacking assistance device and system which may driven simply by the existing movement of an exiting paper sheet, yet can correct the below-noted and other serious sheet handling problems.

The disclosed embodiment provides a simple and very low cost solution for longstanding problems of sheet handling in reproduction apparatus tending to induce serious sheet jam, misfeed, disordering and/or dishevelment problems. Thus, the disclosed device and system can provide for more reliable document reproduction apparatus and/or duplexing path in a reproduction system.

One such sheet handling problem in document reproduction apparatus is the tendency of the trail ends of some sheets, especially if light weight or curled, to "hang up" or remain in a sheet ejection nip, rather than fully exiting the nip for proper stacking (or further transport). That is especially a problem with low velocity (low kinetic energy) sheets being fed into shallow stacking trays. It can also block or interfere with the feeding and/or stacking of succeeding sheets or cause sheet scatter ot other stack integritiy problems. Prior art rubber or plastic flappers or rotating brushes have been used at the exit nip to "knock down" sheet trail ends. E.g., Xerox Corporation U.S. Pat. No. 4,988,087 and art cited therein. However, they tend to be noisy, require drive system powering, and can even mark or smear some images, in some cases.

Another difficult sheet handling problem, which can occur in combination with the above problems, is in reversing sheet handling systems. In particular, those in which an output tray or other sheet exiting area is part of an inverter system in which sheets can be reversed while they are still in the nip of exit rolls but extending out into the exit tray, as in a duplex document handler or copy sheet duplexing path system. An example of a reversing exit nip duplex document handler is illustrated herein and in Xerox Corporation U.S. Pat. No. 5,339,139 issued Aug. 16, 1994. Examples of a reversing exit nip copy sheet duplexing path system are shown in Xerox Corp. U.S. Pat. Nos. 4,916,493 and 5,014,976. Such exit nip sheet reversing systems can be desirably compact and space saving, but the reversing sheets and rolls tend to interfere with stacking and/or inadvertently pull back into the exit rolls nip the preceding or previously fed sheet, especially if that sheet was not fully ejected, or was curled and/or only partially stacked on top of the stack in the exit tray. That is, sheets may not totally exit from the exit nip and/or have resulting poor stack integrity, and there is also possible drag-back of previously stacked sheets into the nip when the nip is reversed for duplex imaging, scanning or printing of that reversed sheet. Said Xerox Corp. U.S. Pat. No. 4,916,493 issued Apr. 13, 1990, and U.S. Pat. No. 5,014,976 issued May 14, 1991 discuss this problem and provide operative reversing nip sheet separator solutions. However, it may be seen that these other patented systems are different and more complex than the system disclosed herein.

The disclosed embodiment is particularly advantageous for automatically feeding a set of document sheets to be electronically imaged from one or both sides in a digital copier, scanner, and/or facsimile machine in serial order with a very compact and low cost but reliable document feeding apparatus. The disclosed embodiment is particularly advantageous for more reliably automatically feeding and/or imaging simplex and duplex document sheets to be electronically imaged from one or both sides in a digital copier, scanner, and/or facsimile machine (or a multi-mode combined such machine) in correct serial page order, with a compact, simple and low cost but reliable document feeding apparatus.

Sheet jam or misfeed avoidance is important to any document handler or reproduction device sheet feeder, but is especially important for remote scanners, fax or multifunction machines, where the output (printed copies) cannot be checked for errors because it is not at the same location as the image input. Job recovery necessitated by a jam or misfeed can be quite complicated, especially if duplex or two sided documents (requiring inversion) were being imaged or copied. If job recovery is not done fully correctly, it will result in scrambled or uncollated copies being printed thereafter from that job set of documents. Where the printing is remote, such job recovery error may not be detected until after an entire print run of that job at all the remote print locations. With bound copy sets, the entire defective print run may have to be destroyed at each location.

More specifically, features disclosed in the specific exemplary embodiment herein include, in a sheet output system with a stacking tray for a reproduction apparatus, in which sheets sequentially moving in an output path are sequentially fed out from a sheet ejection nip for stacking in said stacking tray, an improved sheet separating assistance system operatively associated with said output path comprising a sheet separator unit with a limited plural number of widely circumferentially spaced and substantially radially extending sheet separating arms, said sheet separator unit being rotatably mounted adjacent to said sheet ejection nip with at least one said separating arm automatically normally extending into said output path for engagement by a moving sheet in said output path, said sheet separator unit being partially rotated by said engagement of said moving sheet in said output path while maintaining at least one said separating arm in contact with said moving sheet as said moving sheet is fed out from said sheet ejection nip to provide sheet separating assistance.

Further disclosed features of the exemplary embodiment herein include, individually or in combination, those wherein said sheet separator unit is rotated solely by said engagement in said output path of said moving sheets lead edge with one said separating arm to thereby provide a partial rotation of said sheet separator unit and/or one said separating arm of said sheet separator unit automatically partially holds up a sheet relative to said stacking tray as the sheet is fed out from said sheet ejection nip and/or wherein said sheet separator unit is rotatably mounted adjacent to said sheet ejection nip with a mounting system providing a limited plural number of widely circumferentially spaced detent positions, in each of which detent positions at least one said separating arm is automatically normally held in said output path and/or wherein said sheet separator unit is rotatably mounted with an eccentric over-center mounting system comprising a large generally polygon shaped mounting aperture with plural corners in said sheet separator unit mounted on a substantially smaller mounting axis member for eccentric movement of said sheet separator unit about said mounting axis member between plural detent positions defined by said corners of said mounting aperture and/or further including a duplex sheet path and a sheet ejection nip reversing drive system for reversing the direction of motion of a sheet in said sheet ejection nip to reverse feed sheets into said duplex sheet path, where said sheet separator unit functions to prevent a sheet previously fed out from said sheet ejection nip for stacking from being fed back into said reversed sheet ejection nip by automatic interposition of a said separating arm and/or wherein said sheet separator unit has only 2 to 4 said separating arms and/or wherein said sheet separator unit has only three said separating arms and/or, wherein said sheet separator unit has three said separating arms, and wherein said sheet separator unit is rotatably mounted with a mounting system providing three correspondingly circumferentially spaced detent positions in each of which one said separating arm is automatically normally held in said output path, and/or wherein said mounting system comprises a stationary mounting pin adjacent said sheet ejection nip and a large eccentric mounting aperture in said sheet separator unit, said mounting aperture having three corner positions, and said aperture being rotatable and slideable about said mounting pin so that said sheet separator unit is moved eccentrically around said mounting pin from one said corner position to the next said corner position by each sheet in said output path, and is free to rotate to align the center of gravity of said sheet separator unit in each said corner position under said mounting pin to provide a gravity detent of said sheet separator unit in which one said separating arm is automatically held up into said output path.

By way of general background, as scanners, printers, copiers and/or plural-mode integral such devices or systems increase in speed, and become more automatic, it is increasingly important to provide higher speed yet more reliable and more automatic handling and control of the document sheets being imaged and/or copied, i.e., the document input. It is desirable to reliably feed and register document sheets sequentially, even though the documents may present a variety or mixture of sizes, types, weights, thickness, materials, conditions and susceptibility to damage. "Originals" are often previous copies, with curls, fuser oil, etc.

In the description herein the term "document" or "sheet" refers to a usually flimsy sheet of paper, plastic, or other such conventional individual image substrate, and not to microfilm or electronic images which are generally much easier to manipulate. The "document" is the sheet (original or previous copy) being imaged. A "simplex" document (or copy sheet) is one having its image and page number on only one side or face of the sheet, whereas a "duplex" document (or copy sheet) has "pages", and normally images, on both sides, i.e., each duplex document is considered to have two opposing sides, faces, or "pages" even though no physical page number may be present.

As to specific hardware components in connection with the embodiments of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Figure 3:
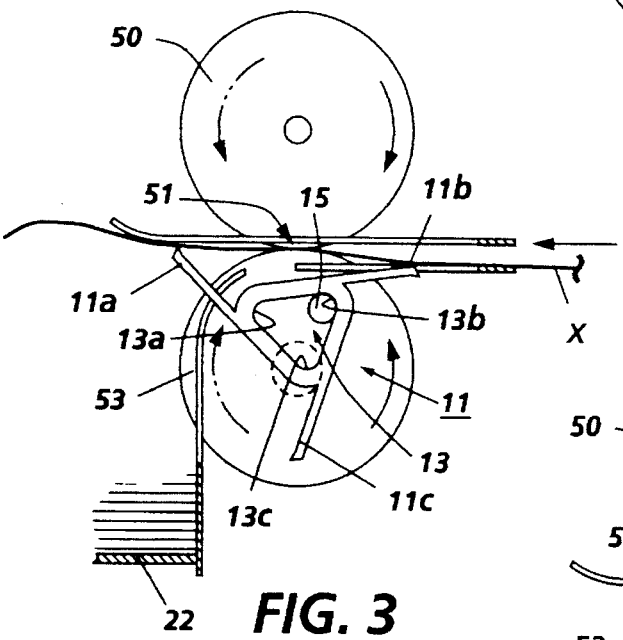
Figure 4:
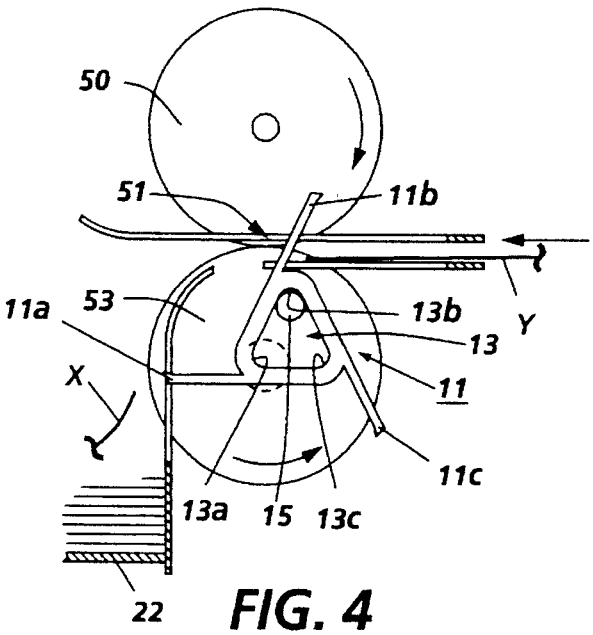
Figure 5:
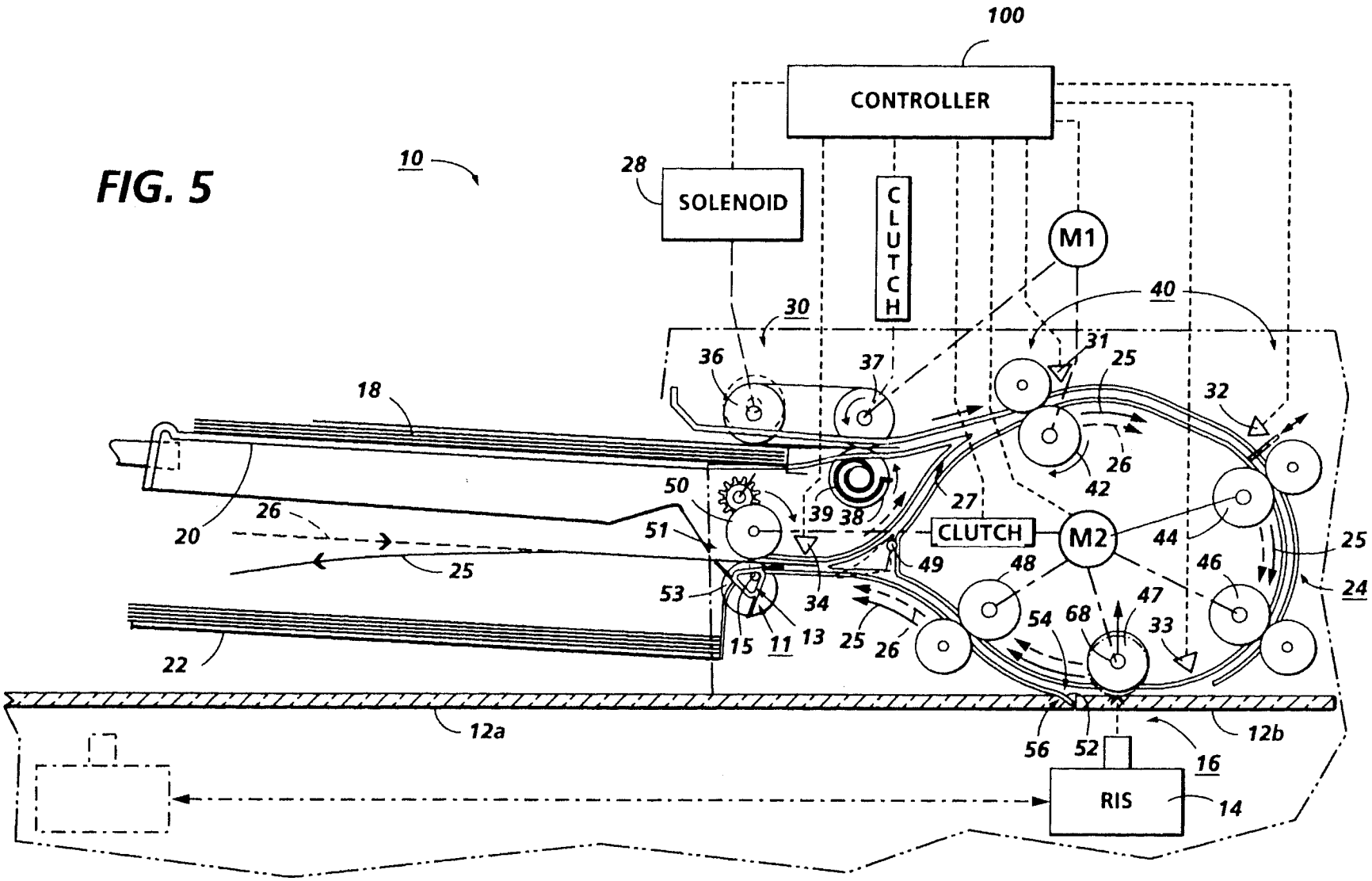

Various of the above-mentioned and further features and advantages will be apparent from the specific apparatus and its operation described in the example below, as well as the claims. Thus, the present invention will be better understood from this description, including the drawing figures (approximately to scale) wherein:

FIGS. 1–4 show sequential operating positions of a partially schematic enlarged partial front view of one embodiment of an exemplary compact sheet separating system; and FIG. 5 shows the sheet separating system of FIGS. 1–4 in an exemplary simplex and duplex document handling system with sheet output nip reversal for duplex documents.

Describing now in further detail the exemplary embodiment with reference to the Figures, first, there is shown in FIG. 5 an exemplary document handler 10 providing the advantageous features noted above for an electronic copier and/or scanner, incorporating one example 11 of the subject sheet separation and stacking assistance system (shown enlarged in FIGS. 1–4). The exemplary document handling system 10 disclosed in FIG. 5, as in said cited U.S. Pat. No. 5,339,139, includes a desirable small loop document path. It also provides "immediate" type duplex document inversion with the duplex sheet inverter chute path located over the top of the stack in the return or exit tray and under the input tray. This highly compact and lightweight document handler 10 may be a part of an optional or add-on top module of a convertible digital copier/scanner unit (not fully shown). A platen 12 is provided with a large platen portion 12*a*, which may be scanned by a rastor input scanner or RIS 14, also part of the module. The exemplary RIS 14 here may be, e.g., a diode type full width array of a conventional type for high resolution, scanning closely under the platen. The entire scanner or input module, including the platen 12 and the RIS 14 desirably may be a removable top module so that the underlying processor or printer unit may alternatively be used as a stand alone or remote digital printer for remote electronic input. With the top module, including the document handler 10, mounted on the digital printer unit, the integrated unit provides a fully integrated convenience copier which even a casual operator may use simply by placing documents 18 in a document input tray 20 and automatically copying them at an imaging station 16 as if this were a normal light lens copier rather than a digital copier. Alternatively, the same document input at imaging station 16 (or platen portion 12*a*) provided here may also be easily used for facsimile transmissions. In that case the documents 18 will be similarly electronic imaged by RIS 14, but then transmitted over telephone lines or any other communications media, with or without electronic storage or buffering. Only the relevant portions of the digital copier top module and its document handler 10 need be illustrated here since the digital printer or copy processor on which it may be mounted may be any of various known, conventional, or new electronic printer units, which do not per se form part of this invention, and therefore need not be described.

The same RIS 14 in this example may be utilized for scanning documents manually placed on the platen portion 12*a* as well as documents which are automatically fed to be imaged on platen portion 12*b* by the document handler 10. This is provided here by a two part platen 12 comprising a full size scanning platen portion 12*a* and a narrow slit scanning portion 12*b*. As may be seen, these two platen portions 12*a* and 12*b* are preferably closely adjacent one another and in the same plane and utilize the same frame mounting and/or alignment system. The two document trays 20, 22 may thus also primarily overlay the platen portion 12*a* rather than extend the machine footprint.

In the disclosed CVT (constant velocity transport) system, including a driven over-platen roller 47, all three document feeding rollers, 46, 47 and 48 may be commonly driven by the same motor, such as servo motor M2, at the same speed, while the document is being imaged. The pre and post platen document feeding roller surfaces 46, 48 may, if desired, be metallic drive rollers, grit blasted, for increased long term drive radius stability and velocity control as compared to conventional elastomer document feeding surfaces.

The document handler 10 feeds documents to be imaged at a constant velocity with this CVT system past a scanning or slit image station 16 which is at the slit scanning platen portion 12*b*, as shown. For this document handler 10 document imaging, the RIS 14 is "parked" at this imaging station 16.

Documents 18 may be loaded face up in normal order in the document input tray 20 of the document handler 10 when automatic document input is desired. The stack of documents is then sequentially fed from the input tray 20 through a short, highly compact, "U" shaped document path 24 for imaging at the imaging station 16, and then after one imaging the simplex documents are fed directly on to a document output tray 22 in which the documents are restacked face down. However, as will be described, there is a partial difference in the document paths provided for simplex documents as compared to duplex documents. This is illustrated here by solid arrows representing the simplex document path 25 and dashed line arrows representing the duplex path 26. Note, however, that both simplex and duplex documents are ejected and restacked in the same document output tray 22 here, in the same manner, after their copying is completed.

The document input tray 20 here is closely superimposed above the document output tray 22. That is, these two trays closely overlay one another to form a relatively enclosed space between the two trays. Yet, both trays are readily operator accessible. This space between the two trays 20 and 22 provides a protective and space saving inverter chute for duplex documents which are being inverted between the copying of their first and second sides.

Note that the U-shaped document path 24 contains a single natural inversion for turning each document sheet over once between its infeeding from input tray 20 and the imaging station 16. This is the only inversion in this document path 24. And there is no inversion in the duplex path 27 added portions. The document path 24 is like a "U" lying on its side, facing and connecting with the input tray 20 and output tray 22 at the upper and lower ends of the "U", and with the imaging station 16 on the bottom side of the "U". It may also be seen that the duplex document path 27 utilizes the same U-shaped document path 24 shared by both simplex and duplex documents, but additionally provides a short duplex documents return path from the output end of the U-shaped document path 24 back to the input of that path 24, as will be further described.

All of the document sheet feeding in the document path 24, including the duplex document path 27 portions, and the imaging station 16, are all provided in this example by only two drive motors, a first drive motor M1 and a second drive motor M2, respectively connected to the various document path sheet feeders as illustrated by the illustrated connecting dashed lines. Both of the drive motors M1 and M2, solenoid 72, and a solenoid 28 (for selectively lifting the nudger roll of the input feeder), and the clutches, are controlled by a conventional programmable microprocessor controller 100. Also connecting with the controller 100 in a conventional manner are sheet path sensors for detecting the lead and/or trail edge of document sheets being fed through the document paths 24, 27 such as the illustrated sensors 31, 32, 33, and 34. Thus, these sheet path sensors provide signals to the controller as to the present document position, when the respective sensor is activated. Because the document sheet or a portion thereof is thus known to be in a particular feeding nip moving it at a known speed, its position and movement distance can be predicted in advance by simple timing in the controller 100 in a known manner.

An exemplary top sheet separator/feeder 30 sequentially feeds the top sheet of the stack of documents loaded in the input tray 20 into the U shaped document path 24, and separates each fed sheet from the respective underlying sheets. The sheet separator/feeder 30 may be driven by the motor M1, as shown. A nudger roll 36 is lowered by solenoid 28 onto the top of the stack for feeding or advancing the top sheet or sheets 18 into a positive retard separating nip, comprising a driven first feed roll 37 and an undriven retard roll 38. The driven feed roll 37 rotates to feed the top-most sheet at that point in time downstream into the document path 24, while subsequent or underlying sheets are retarded by the frictional retard roll 38 forming a nip therewith. To prevent wear spots or the like on the retard roll 38, the roller 38 is allowed some limited rotational movement forward or downstream. However, this roller 38 downstream rotation is resisted by a connected return spring 39, which spring 39 is wound up by roller 38 downstream rotation due to the high friction between rollers 37 and 38 when they are directly engaged (with no sheets therebetween). Whenever two or more sheets are in the retard nip between the rolls 37 and 38, the wound-up return spring 39 force is strong enough to overcome the (lesser) friction between the plural sheets in the nip, to push back upstream the underlying sheets, providing improved separation as further explained in the above-cited references. Once the top sheet has been fully acquired and fed downstream past the adjacent sensor 31, the nudger 36 may be lifted to prevent inadvertent further feeding therewith of an underlying sheet, and prevent smearing of document images. The initial sheet input velocity is preferably faster than the normal CVT velocity in the main portion of the document path. That higher initial velocity enables the lead edge of the (next) document being inputted to catch up with (close or minimize the inter-document pitch or gap with) the trail edge of the previous document in the document path.

Once a top sheet has been separated and fed into the document path 24 as described above, it then enters the regular document path sheet drive system 40. This will be described here with reference to the driven rollers, although the mating and nip-defining idler rollers are also illustrated. As shown, these document path sheet drive rollers of this example comprise, in order: second or take-away rolls 42, registration rollers 44 substantially spaced downstream thereof, with an intermediate sheet deskew buckle chamber area therebetween, then first CVT rolls 46, then an imaging station 16 with a platen overlying sheet holddown CVT roller 47, then third CVT rolls 48, and then (after passing a pivotal gate 49) reversible exit nip rolls 50 at the entrance to the output tray 22.

The illustrated imaging station CVT roller 47 may be gravity or spring loaded against the platen, and may also provide, or be associated with, an imaging background surface for appropriate image background for the document being imaged at that point. It provides the control of the document being imaged to maintain all of document within the depth of field and focus of the imaging system as the document passes through the imaging station, i.e., to maintain a uniform restricted (very narrow height) maximum spacing gap above the imaging plane at the platen upper surface, of, e.g., less than 0.5 mm.

There is also shown here a platen gap 54 by a beveled platen edge 56 on the main or full size platen portion 12*a* end facing 12*b*, as shown. As described in more detail in said U.S. Pat. No. 5,339,139, this provides a space or groove extending below the upper surface of the platen portion 12*b* into which a small baffle lip or catch 52 may be desirably attached to edge 56. The baffle lip 52 extends above and below the upper surface of the platen portion 12*b* over which documents are being fed for imaging at the imaging station 16. Thus, the lead edge of documents fed through the imaging station 16 over the platen 12*b* upper surface are positively caught and deflected upwardly into the next feed nip.

Turning now to the exemplary output and duplex document handling system, a gate 49 is located at the downstream end of the U-shaped document path 24, just upstream of the reversible exit nip rolls 50 and at the entrance of the duplex document path 27. The gate 49 does not obstruct documents coming from the imaging station 16, irrespective of whether they are duplex or simplex documents. All documents here go directly past the imaging station 16 into the nip of the exit rolls 50. Simplex documents are desirably fed on by these rolls 50 without any reversal thereof out into the exit tray 22 for restacking there in proper collated page order. These documents stack face down in 1 to N order, if the documents were fed face up in 1 to N order from the input tray 20 and were inverted once in the U-shaped document path 24.

However, for duplex documents which have been imaged on their first side and are yet to be imaged on their second side, as soon as the trail edge of the duplex document passes the sensor 34, the controller 100 directs the reversal of the exit rolls 50. The duplex document sheet at that point is, as shown, extending substantially (for most of its length) out into the above-described inverter chute space between the trays 20 and 22. That duplex document sheet may now be rapidly reversed (feeding much faster than the CVT velocity) to be drawn back into the document handler toward the gate 49 by reversing rollers 50 at that point. The gate 49 is either solenoid or cam actuated or gravity loaded at this point into a position in which, as shown in phantom, the reversed duplex document is directed up into the duplex path 27. This duplex path 27 forms a return path of the duplex documents back into the entrance of the U-shaped path 24, as previously noted.

While the document sheet is being driven forward by the CVT drive system of M2 driving lower rolls 46, 47 and 48 forward, the output roller 50 in that same path is desirably also driven forward by M2 at the same speed. However, when a duplex document is to be reversed, this may preferably be done by a clutch disconnecting the roller 50 shaft from M2, and then a simple reverse gear drive of the roller 50 shaft may be electrically clutched in at that point, as illustrated, to motor M1, while M1 continues to drive forward (downstream) the upper rollers 42 and 44 towards which the reversed document is fed by M1 reverse driven roller 50. To express it another way, for reversing, the clutch between roller 50 and M2 is disengaged and the clutch from M1 to the reverse gear drive for roller 50 is engaged. (Alternatively, a separate motor may be provided, if desired.) Note that for long duplex documents, this allows the trail end of the long duplex document to still be reverse fed out of roller 50 while the front end of that long document is already at the same time being fed forward through the CVT system for imaging by rollers 46, 47 and 48 driven forward by M2.

The combined duplex documents path 24, 27 provides a complete loop, as may be seen. This complete duplexing loop 24, 27 is quite small and compact. Desirably, it has dimensions only slightly larger than that of the longest document dimension to be fed therethrough. That is, this system is operative as long as the trail edge of the duplex document being inverted clears the sensor 34 before the lead edge of that same document sheet returns to the sensor 34 through the loop path 27, 24 after having its second side imaged at the imaging station 16.

This refeeding of duplex document sheets through the path 27 and 24 for second side imaging turns those document sheets over a second time. For proper collated output into the output tray 22, the duplex documents may be re-inverted before restacking by being again fed back through the same path 27, 24 in the same manner, utilizing the same reversal of the exit rolls 50, but passing through without imaging, and then ejected (by not reversing the exit rolls 50). Thus, the duplex document is then ejected, properly oriented face down, into the output tray 22. Face down output for duplex documents is, of course, with the first or odd side page down, since this is a 1 to N system.

Referring to the duplex document scanning sequences available, the simplest sequencing algorithm is to process all documents in a simple 1 to N sequence, including "immediate duplex" sequencing of duplex originals. That is, side 2 of each duplex document may be scanned directly after side 1, followed by side 1 of the next fed document, etc. [Thus, one does not have to have 2 sheets in a document path at once.] The duplex document scanning sequence here may thus be side 1 of 1, skip, side 2 of 1, skip, side 1 of 2, skip, etc., relative to a normal inter-document gap for simplex documents feeding in this example of approximately 30 mm. Each "skip" is for inverting the document by reversal of the exit rolls 50 to feed that sheet back through the clockwise CVT path loop again; first for imaging its second side, and then for a non-imaging pass of the document sheet for re-inverting it again for proper output stacking. There is no need for deskew, constant velocity, or slowing down for CVT scan in this non-imaging pass. Thus, this third, non-imaging, document loop pass is desirably at a substantially higher (slew rate) velocity, to save time and increase overall duplex productivity. (However, the short path, simple drives and close document spacing may not allow that.) As noted, after the duplex sheet is fed through the document path for the third time, it returns back to the reversible exit rolls for the last time and is ejected to stack in collated order. However, it will be appreciated that there are other document sequencing alternatives.

Figure 2:
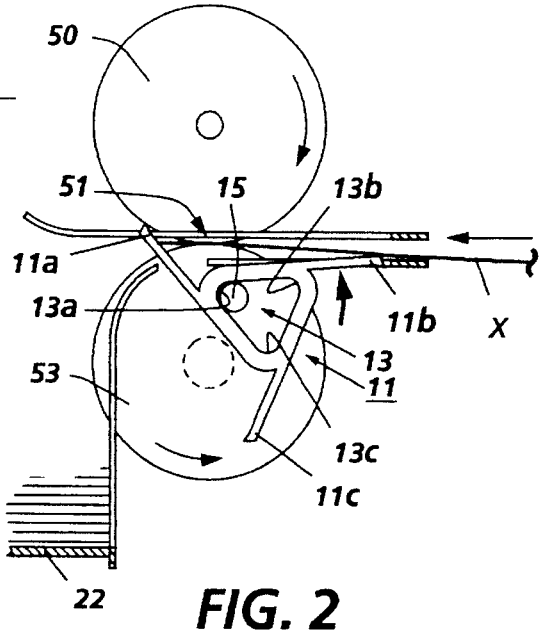

FIGS. 1–4 provide an enlarged view of the exemplary sheet separator system 11 per se, in sequential operating positions, as will be further described later hereinbelow. FIG. 1 shows a sheet "X" entering (approaching) the exit nip 51 of exit rolls 50 and their idler rolls 53. FIGS. 2 and 3 show what happens as the sheet passes through the exit nip 51. FIG. 4 shows the ejection of sheet X and the entrance of the next sheet "Y" to the exit area.

The disclosed embodiment 11 does not require any addition of any actively driven moving parts to an existing document handler, such as 10 here, or reproduction apparatus. Only a simple low cost undriven or passive device or element 11 need be added. The unit 11 here is a small three armed sheet separator in the sheet exit nip 51 area, which is driven only by the moving paper sheet itself, yet can correct the above-noted and other sheet handling problems. The integral, unitary or monolithic single piece device 11 illustrated here has three extending rigid arms or fingers, which three arms may be identical, but are labeled here 11*a*, *b* and *c* for descriptive illustration. It may be made as a small and relatively thin molded plastic part. One or more such separating devices 11 can be used, spaced transverse the paper path.

A unique mounting is provided for the sheet separating device 11. The triangular shape of its large mounting hub or aperture 13 automatically normally positions the three armed sheet separator 11 with one arm semi-vertically in the exit nip paper path, as in FIG. 1 and FIG. 4. As a sheet X is fed up to rollers 50 and then through the exit nip 51, that one arm (11*a* in FIG. 2 and FIG. 3) is driven downstream by the moving sheet lead edge. This sheet induced motion causes rotation (FIG. 2) and then translation (FIG. 3) of the device 11 eccentrically on its triangular hub 13 about its mounting shaft 15. This movement of the device 11 causes an arm to guide in the incoming sheet above the prior sheets already stacked in the exit tray 22, as in FIG. 3, and also to knock off any sheets hung up on the exit nip idler roll 53. This cycle repeats for the next entering sheet Y, of FIG. 4, and so on. Each incoming sheet partially rotates the device 11, from one detent position 13*a* to a second 13*b*, to a third 13*c*, and so on. In each said detent position the unit 11 hangs by gravity on pin 15 with one associated arm extended up into the paper path.

To express this further, the device 11 always initially rotatably re-positions itself by gravity in one of its three predetermined positions, due to its large triangular or trapezoidal center aperture 13, which is much larger than the diameter of the shaft 15 on which it is loosely mounted. That may be a separate shaft 15 adjacent the exit nip 51, as shown, or alternatively, the shaft of one of the exit rollers. This loose and unusually shaped mounting of the device 11 automatically re-positions the device 11 by gravity on one of three excentric suspension points 13*a, b,* or *c,* in the corners of aperture 13, whenever a sheet is not present. This automatically positions one of its 3 arcuate fingers 11*a, b* or *c* in the sheet exit path so that the lead edge of the entering sheet always catches and flips over the next one of the three arcuate fingers projecting into the sheet path. Thus, at least one of the fingers 11*a, b,* or *c,* is always positioned to provide separation, and also to keep the prior sheet from being reacquired by the exit nip 51 when a sheet is reversed in that nip. Furthermore, if a sheet trail edge hangs up in the area of the nip, the very next entering sheet causes the device 11 to again partially rotate and thus push, with a finger, that preceding hung up sheet out and down into the exit tray 22.

The system is passive but automatic due to this over-center mounting. With the disclosed system, each incoming sheet pivots the unit 11 about 60 degrees, then pushes it downstream by one detent, e.g., from one detent 13*a* to the next detent 13*b*, where it hangs up by gravity stably on pin or shaft 15 because the center of gravity of the unit 11 is then below the axis of pin 15. In positions between detents the center of gravity is, as shown, off-axis and thereby rotates the unit 11 into its next stable or detent position, in which one arm 11*a, b,* or *c,* projects into the path to receive the next document by extending through and above nip 51. The weight of the trail edge of a sheet released by nip 51 on the downstream arm can also assist in rotation of device 11 to its next detent position.

Three arms have been found to be optimal, although two arms might work with more space, and four arms might also work with, of course, a different detent system than the three detents 13*a, b, c,* provided by the illustrated system.

As shown in FIG. 2 and FIG. 3, it is also important to note that while a sheet is passing through nip 51, the second or next arm 11*b* is riding up underneath, and held down by, the bottom of the sheet upstream of exit nip 51 while the first or prior arm 11*a* is holding up the exiting portion of the sheet downstream of exit nip 51. This first arm 11*a* thus holds the second arm 11*b* in position during the sheet exiting (FIGS. 2 and 3) in what is otherwise an unstable (unbalanced) position. Thus, each sheet exits out of nip 51 directed upwardly, and above the exit nip, by one arm 11*a* of the device 11, over the top of that arm, as in FIG. 3, while the device 11 is held from rotation by the upstream area of that sheet riding on the upstream arm 11*b*. As shown, the arm 11*a* previously driven downstream by the sheet lead edge thus holds the sheet above the other sheets previously ejected.

Further advantages will be apparent from this illustrated system 11 example, including duplexing, as previously discussed, in which rollers 50 are reversed in the FIG. 3 position. The sheet separation advantages of device 11 are maintained in this mode, and in adition, the above-noted problem of inadvertent sheet recapture in the reversed nip is greatly reduced by the same arm position and action. Note the dashed line alternative arrows in FIG. 3 showing the optional reversal of the rollers 50 drive for duplexing.

While the embodiments disclosed herein are preferred, it will be appreciated from this teaching that various alternatives, modifications, variations or improvements therein may be made by those skilled in the art, which are intended to be encompassed by the following claims:

What is claimed is:

1. In a sheet output system with a stacking tray for a reproduction apparatus, in which sheets sequentially moving in an output path are sequentially fed out from a sheet ejection nip for stacking in said stacking tray, an improved sheet separating assistance system operatively associated with said output path comprising a sheet separator unit with a limited plural number of widely circumferentially spaced and substantially radially extending sheet separating arms, said sheet separator unit being rotatably mounted adjacent to said sheet ejection nip with at least one said separating arm automatically normally extending into said output path for engagement by a moving sheet in said output path, said sheet separator unit being partially rotated by said engagement of said moving sheet in said output path while maintaining at least one said separating arm in contact with said moving sheet as said moving sheet is fed out from said sheet ejection nip to provide sheet separating assistance; wherein said sheet separator unit is rotatably mounted adjacent to said sheet ejection nip with a mounting system providing a limited plural number of widely circumferentially spaced detent positions, in each of which detent positions at least one said separating arm is automatically normally held in said output path.

2. The sheet output system of claim 1, wherein said sheet separator unit is rotated solely by said engagement in said output path of said moving sheets lead edge with one said separating arm to thereby provide a partial rotation of said sheet separator unit.

3. The sheet output system of claim 1, wherein one said separating arm of said sheet separator unit automatically partially holds up a sheet relative to said stacking tray as the sheet is fed out from said sheet ejection nip.

4. The sheet output system of claim 1, wherein said sheet separator unit is rotatably mounted with an eccentric over-center mounting system comprising a large generally polygon shaped mounting aperture with plural corners in said sheet separator unit mounted on a substantially smaller mounting axis member for eccentric movement of said sheet separator unit about said mounting axis member between plural detent positions defined by said corners of said mounting aperture.

5. The sheet output system of claim 1, further including a duplex sheet path and a sheet ejection nip reversing drive system for reversing the direction of motion of a sheet in said sheet ejection nip to reverse feed sheets into said duplex sheet path, where said sheet separator unit functions to prevent a sheet previously fed out from said sheet ejection nip for stacking from being fed back into said reversed sheet ejection nip by automatic interposition of a said separating arm.

6. The sheet output system of any of claims 1 through 5, wherein said sheet separator unit has only 2 to 4 said separating arms.

7. The sheet output system of any of claims 1 through 5, wherein said sheet separator unit has only three said separating arms.

8. The sheet output system of claim any of claims 1 through 5, wherein said sheet separator unit has three said separating arms, and wherein said sheet separator unit is rotatably mounted with a mounting system providing three correspondingly circumferentially spaced detent positions in each of which one said separating arm is automatically normally held in said output path.

9. The sheet output system of claim 8, wherein said mounting system comprises a stationary mounting pin adjacent said sheet ejection nip and a large eccentric mounting aperture in said sheet separator unit, said mounting aperture having three corner positions, and said aperture being rotatable and slideable about said mounting pin so that said sheet separator unit is moved eccentrically around said mounting pin from one said corner position to the next said corner position by each sheet in said output path, and is free to rotate to align the center of gravity of said sheet separator unit in each said corner position under said mounting pin to provide a gravity detent of said sheet separator unit in which one said separating arm is automatically held up into said output path.

* * * * *